US011562699B2

(12) United States Patent
Park

(10) Patent No.: US 11,562,699 B2
(45) Date of Patent: Jan. 24, 2023

(54) DISPLAY DEVICE AND METHOD FOR DRIVING THE SAME

(71) Applicant: LG Display Co., Ltd., Seoul (KR)

(72) Inventor: Sang Hyun Park, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/516,822

(22) Filed: Nov. 2, 2021

(65) Prior Publication Data

US 2022/0139332 A1 May 5, 2022

(30) Foreign Application Priority Data

Nov. 3, 2020 (KR) ..... 10-2020-0145363

(51) Int. Cl.
*G09G 3/3283* (2016.01)

(52) U.S. Cl.
CPC ..... *G09G 3/3283* (2013.01); *G09G 2300/0833* (2013.01); *G09G 2300/0842* (2013.01); *G09G 2310/08* (2013.01)

(58) Field of Classification Search
CPC ..... G09G 3/3283; G09G 2300/0833; G09G 2300/0842; G09G 2310/08; G09G 2310/0291; G09G 2320/0233; G09G 3/3233; G09G 2300/0426; G09G 2300/0819; G09G 2320/0295; G09G 3/3275; G09G 3/3291
See application file for complete search history.

(56) References Cited

U.S. PATENT DOCUMENTS

| | | | | |
|---|---|---|---|---|
| 10,777,140 | B2 | 9/2020 | Kim et al. | |
| 2012/0299978 | A1* | 11/2012 | Chaji | G09G 3/006 345/690 |
| 2015/0123953 | A1* | 5/2015 | Shim | G09G 3/3233 345/205 |
| 2019/0325822 | A1* | 10/2019 | Li | G09G 3/3266 |

FOREIGN PATENT DOCUMENTS

| | | | |
|---|---|---|---|
| KR | 10-2016-0032759 | A | 3/2016 |
| KR | 10-2019-0140760 | A | 12/2019 |
| KR | 10-2020-0060903 | A | 6/2020 |

* cited by examiner

*Primary Examiner* — Md Saiful A Siddiqui
(74) *Attorney, Agent, or Firm* — Birch, Stewart, Kolasch & Birch, LLP

(57) ABSTRACT

A display device according to an embodiment of the present disclosure includes a light-emitting element configured to emit light, a driving transistor configured to provide a high-level voltage to the light-emitting element, and a switching transistor configured to transfer a voltage input through a data line to a gate node of the driving transistor. The driving transistor operates in a saturation mode in which a voltage of a source node is saturated in response to a first data voltage input to the gate node, and operates in a switch mode in which the driving transistor operates as a switch in response to a second data voltage higher than the first data voltage, so that a driving current generated in the driving transistor is able to be sensed through the source node.

18 Claims, 10 Drawing Sheets

DISPLAY DEVICE AND METHOD FOR DRIVING THE SAME

CROSS-REFERENCE TO RELATED APPLICATIONS

This application claims the priority benefit of Korean Patent Application No. 10-2020-0145363, filed in the Republic of Korea on Nov. 3, 2020, the entire contents of which are hereby expressly incorporated by reference as if fully set forth herein into the present application.

BACKGROUND OF THE INVENTION

Field of the Invention

The present disclosure relates to a display device and a method for driving the same.

Discussion of the Related Art

Electroluminescent display devices are classified into inorganic light-emitting displays and electroluminescent displays according to emission layer materials. Each sub-pixel of an electroluminescent display includes a self-emitting element and adjusts luminance by controlling the amount of emission of light of the light-emitting element according to grayscales of image data.

Each sub-pixel circuit of the electroluminescent display can include a driving transistor that supplies a sub-pixel current to a light-emitting element, and at least one switching transistor and a capacitor that program a gate-source voltage of the driving transistor.

Since manufacturing cost increases and a time needed for sensing and compensation also increases as the complexity of a sub-pixel circuit increases, research for reducing the complexity of the sub-pixel circuit is continuing.

SUMMARY OF THE INVENTION

Accordingly, the present disclosure is directed to a display device and a method for driving the same that substantially obviate one or more problems due to limitations and disadvantages of the related art.

An object of the present disclosure is to provide a display device and a method for driving the same to reduce the complexity of a sub-pixel circuit.

To achieve these objects and other advantages and in accordance with the purpose of the invention, as embodied and broadly described herein, a display device includes a light-emitting element configured to emit light, a driving transistor configured to provide a high-level voltage to the light-emitting element, and a switching transistor configured to transfer a voltage input through a data line to a gate node of the driving transistor, wherein the driving transistor operates in a saturation mode in which a voltage of a source node is saturated in response to a first data voltage input to the gate node and in a switch mode in which the driving transistor operates as a switch in response to a second data voltage higher than the first data voltage so that a driving current generated in the driving transistor is able to be sensed through the source node.

The driving transistor can operate as a source follower in the saturation mode so that the source node is saturated to a voltage obtained by subtracting a threshold voltage of the driving transistor from the first data voltage, and the voltage of the source node can increase from the saturated voltage to the high-level voltage in the switch mode.

A first high-level voltage (e.g., EVDD_1) can be applied to a drain electrode of the driving transistor in the saturation mode, and a second high-level voltage (e.g., EVDD_2) lower than the first high-level voltage (e.g., EVDD_1) can be applied to the drain electrode of the driving transistor in the switch mode.

A low-level voltage (e.g., EVSS_High) higher than a voltage in a display mode can be applied to a cathode of the light-emitting element in the saturation mode, and the cathode of the light-emitting element can be electrically floating in the switch mode.

The display device can further include a sensor configured to integrate a current input from the source node of the driving transistor and to output the integrated current as a sensing voltage related to characteristics of the driving transistor.

The sensor can include an amplifier configured to output the sensing voltage in response to the current input from the source node of the driving transistor.

The sensor can include an integral capacitor connected between an input terminal and an output terminal of the amplifier, and a first switch connected between both ends of the integral capacitor, turned on in the saturation mode, and turned off in the switch mode.

An inverted input terminal, a non-inverted input terminal, and the output terminal of the amplifier can be initialized to a reference voltage in the saturation mode, and the amplifier can output the sensing voltage through the output terminal in response to the current input from the source node of the driving transistor in the switch mode.

The sensor can include a second switch connected to the output terminal of the amplifier and configured to sample the sensing voltage, and an analog-to-digital converter configured to convert the sampled sensing voltage into a digital sensing value and to output the digital sensing value.

In another aspect of the present disclosure, a display device includes a display panel including sub-pixels and a sensor configured to sense a current input from each sub-pixel, wherein each sub-pixel includes a light-emitting element configured to emit light, a switching transistor configured to transfer a voltage input through a data line to a gate node of a driving transistor, and the driving transistor controlling the quantity of current input to the light-emitting element according to the voltage input to the gate node in a display mode and operating in a saturation mode in which a voltage of a source node is saturated in response to a first data voltage input to the gate node and in a switch mode in which the driving transistor operates as a switch in response to a second data voltage higher than the first data voltage so that a driving current generated in the driving transistor is able to be sensed through the source node in a sensing mode.

The driving transistor can include a drain electrode to which a high-level voltage is applied, a gate electrode electrically connected to a first electrode of the switching transistor, and a source electrode electrically connected to an anode of the light-emitting element.

The display device can further include a power supply configured to supply a first high-level voltage (e.g., EVDD_1) to a drain electrode of the driving transistor and to supply a low-level voltage (e.g., EVSS_High) higher than a voltage supplied in the display mode to a cathode of the light-emitting element in the saturation mode, to supply a second high-level voltage (e.g., EVDD_2) lower than the first high-level voltage (e.g., EVDD_1) to the drain electrode of the driving transistor and to electrically float the cathode of the light-emitting element in the switch mode.

The sensor includes an amplifier including an inverted input terminal through which a current is input from the source node of the driving transistor, a non-inverted input terminal through which a reference voltage is input, and an output terminal through which a sensing voltage is output, an integral capacitor connected between the inverted input terminal and the output terminal, and a first switch connected between both ends of the integral capacitor, turned on in the saturation mode, and turned off in the switch mode.

In another aspect of the present disclosure, a method for driving a display device including light-emitting elements and driving transistors for driving the light-emitting elements includes executing a saturation mode in which a first data voltage is applied to a gate node of each driving transistor so that a voltage of a source node of the driving transistor is saturated, and executing a switch mode in which a second data voltage higher than the first data voltage is applied so that a driving current generated in the driving transistor is able to be sensed through the source node of the driving transistor.

The executing of the saturation mode can include applying a first high-level voltage (e.g., EVDD_1) to a drain electrode of the driving transistor, and applying a low-level voltage (e.g., EVSS_High) higher than a voltage supplied in a display mode to a cathode of each light-emitting element.

The executing of the switch mode can include applying a second high-level voltage (e.g., EVDD_2) higher than the first high-level voltage (e.g., EVDD_1) to the drain electrode of the driving transistor, and electrically floating the cathode of each light-emitting element.

The method can further include integrating a current input from the source node of the driving transistor and outputting the integrated current as a sensing voltage related to characteristics of the driving transistor.

The display device can include a sensor including an amplifier having an inverted input terminal through which the current is input from the source node of the driving transistor, a non-inverted input terminal through which a reference voltage is input, and an output terminal through which the sensing voltage is output, an integral capacitor connected between the inverted input terminal and the output terminal, and a first switch connected between both ends of the integral capacitor, and the method can include turning on the first switch so that the inverted input terminal, the non-inverted input terminal, and the output terminal of the amplifier are initialized to the reference voltage in the saturation mode, and turning off the first switch so that the current input from the source node of the driving transistor is received through the inverted input terminal of the amplifier and the sensing output is output through the output terminal in the switch mode.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EMBODIMENTS

Figure 1:
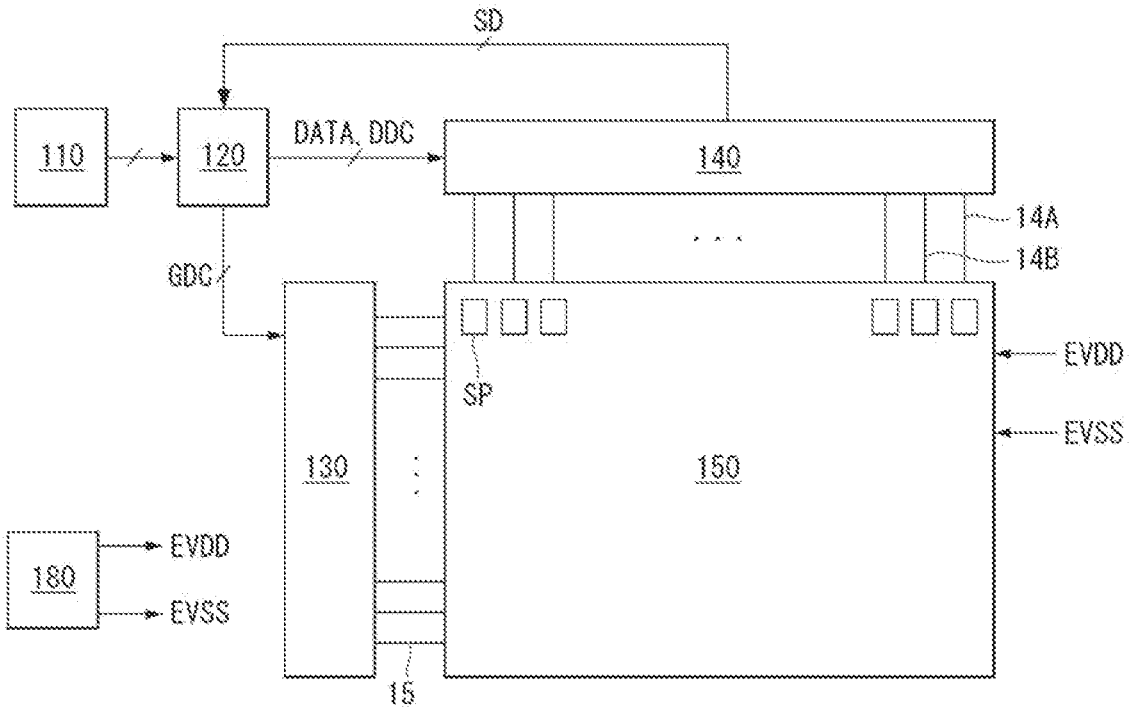
FIG. 1 is a block diagram schematically illustrating a display device according to an embodiment of the present disclosure.

The advantages and features of the present disclosure and the way of attaining the same will become apparent with reference to embodiments described below in detail in conjunction with the accompanying drawings. The present disclosure, however, is not limited to the embodiments disclosed hereinafter and can be embodied in many different forms. Rather, these exemplary embodiments are provided so that this disclosure will be through and complete and will fully convey the scope to those skilled in the art. Thus, the scope of the present disclosure should be defined by the claims.

The shapes, sizes, ratios, angles, numbers, and the like, which are illustrated in the drawings in order to describe various embodiments of the present disclosure, are merely given by way of example, and therefore, the present disclosure is not limited to the illustrations in the drawings. The same or extremely similar elements are designated by the same reference numerals throughout the specification. In addition, in the description of the present disclosure, a detailed description of related known technologies will be omitted when it can make the subject matter of the present disclosure rather unclear. In the present specification, when the terms "comprise", "include", and the like are used, other elements can be added unless the term "only" is used. An element described in the singular form is intended to include a plurality of elements unless the context clearly indicates otherwise.

In the description of the various embodiments of the present disclosure, when describing positional relationships, for example, when the positional relationship between two parts is described using "on", "above", "below", "aside", or the like, one or more other parts can be located between the two parts unless the term "directly" or "closely" is used.

Although terms such as, for example, "first" and "second" can be used to describe various elements, these terms are merely used to distinguish the same or similar elements from each other, and may not define order. Therefore, in the present specification, an element modified by "first" can be the same as an element modified by "second" within the technical scope of the present disclosure unless otherwise mentioned.

Throughout the present specification, the same reference numerals designate the same constituent elements.

Although a sub-pixel circuit and a gate driver formed on a substrate of a display panel can be implemented as thin film transistors (TFTs) in an n-type metal oxide semiconductor field effect transistor (MOSFET) structure in the present disclosure, the present disclosure is not limited hereto and they can be implemented as TFTs in a p-type MOSFET structure. A TFT is a 3-electrode element including a gate, a source, and a drain. The source is an electrode that supplies carriers to the transistor. Carriers flow from the source in the TFT. The drain is an electrode through which carriers are discharged to the outside. For example, carriers flow from the source to the drain in a MOSFET. In the case of an n-type TFT (NMOS), carriers are electrons and thus a source voltage is lower than a drain voltage such that electrons can flow from the source to the drain. Since electrons flow from the source to the drain in the n-type TFT, current flows from the drain to the source. On the contrary, in the case of a p-type TFT (PMOS), carriers are holes and thus a source voltage is higher than a drain voltage such that holes can flow from the source to the drain. Since holes flow from the source to the drain in the p-type TFT, current flows from the source to the drain.

It should be noted that the source and the drain of a MOSFET are not fixed. For example, the source and the drain of a MOSFET can be changed according to an applied voltage. Accordingly, any one of the source and the drain will be described as a first electrode and the other will be described as a second electrode in embodiments of the present disclosure.

Hereinafter, embodiments of the present disclosure will be described in detail with reference to the attached drawings. In the following description, a detailed description of known functions and configurations incorporated herein will be omitted when it can obscure the subject matter of the present disclosure. The same reference numbers will be used throughout this specification to refer to the same or like parts.

Figure 2:
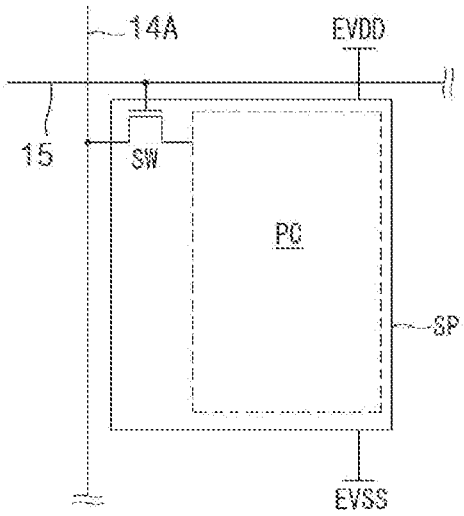
FIG. 2 is a block diagram schematically illustrating a sub-pixel included in the display device of FIG. 1.

FIG. 1 is a block diagram schematically illustrating a display device according to an embodiment of the present disclosure and FIG. 2 is a block diagram schematically illustrating a sub-pixel included in the display device illustrated in FIG. 1. As the display device, a liquid crystal display (LCD) device, a plasma display panel (PDP), an organic light emitting display (OLED) device, an electrophoretic display (ED) device, or the like can be applied. Although a case in which the display device is an OLED device is exemplified in the following description, the present disclosure is not limited thereto. Further, all the components of each display device according to all embodiments of the present disclosure are operatively coupled and configured.

As illustrated in FIG. 1 and FIG. 2, an OLED device according to an embodiment of the present disclosure includes an image provider 110, a timing controller 120, a scan driver 130, a data driver 140, a display panel 150, and a power supply 180.

The image provider 110 (or host system) outputs various driving signals along with an image data signal supplied from the outside or an image data signal stored in an internal memory. The image provider 110 can provide a data signal and various driving signals to the timing controller 120.

The timing controller 120 outputs a gate timing control signal GDC for controlling operation timing of the scan driver 130, a data timing control signal DDC for controlling operation timing of the data driver 140, and various synchronization signals (vertical synchronization signal Vsync and horizontal synchronization signal Hsync).

The timing controller 120 provides a data signal DATA supplied from the image provider 110 along with the data timing control signal DDC to the data driver 140. The timing controller 120 can be configured as an integrated circuit (IC) and can be mounted on a printed circuit board, but the present disclosure is not limited thereto.

A plurality of data lines 14A, a plurality of sensing lines 14B, and a plurality of scan lines 154 are arranged in the display panel 150. Sub-pixels SP are disposed at intersections of the data lines 14A, the sensing lines 14B, and the scan lines 15.

The scan driver 130 outputs a scan signal (or scan voltage) in response to the gate timing control signal GDC supplied from the timing controller 120. The scan driver 130 provides the scan signal to the sub-pixels included in the display panel 150 through the scan lines 15. The scan driver 130 can be configured as an IC or directly formed on the display panel 150 in a gate-in-panel structure, but the present disclosure is not limited thereto.

The data driver 140 converts the data signal DATA into an analog data voltage in response to the data timing control signal DDC supplied from the timing controller 120 and provides the analog data voltage to the display panel 150 in a display mode for displaying an image. In a sensing mode, the data driver 140 can apply a first data voltage to driving TFTs included in the sub-pixels SP such that they operate as source followers and apply a second data voltage to the driving TFTs such that they operate as switches. The data driver 140 senses electrical characteristics of the sub-pixels SP and feeds back sensing data SD to the timing controller 120 in the sensing mode. The data driver 140 can be configured as an IC and mounted on the display panel 140 or a printed circuit board, but the present disclosure is not limited thereto.

The power supply 180 generates a high-level voltage EVDD and a low-level voltage EVSS based on an external input voltage and outputs the high-level voltage EVDD and the low-level voltage EVSS to the display panel 150. In the display mode, the sub-pixels SP of the display panel 150 can emit light in response to the high-level voltage EVDD and the low-level voltage EVSS. The power supply 180 can generate and output voltages (e.g., a high scan voltage and a low scan voltage) necessary for operation of the scan driver 130 or voltages (e.g., drain voltage and half drain voltage) necessary for operation of the data driver 140 as well as the high-level voltage EVDD and the low-level voltage EVSS.

Further, the power supply 180 according to an embodiment of the present disclosure can output high-level voltages EVDD and low-level voltages EVSS having different levels according to control of the timing controller 120 in the sensing mode. For example, the power supply 180 can supply a first high-level voltage EVDD_1 and a second high-level voltage EVDD_2 lower than the first high-level voltage EVDD_1 to a high voltage input terminal of the display panel 150. Further, the power supply 180 can supply a low-level voltage EVSS_High higher than a voltage supplied in the display mode to a low-voltage input terminal of the display panel 150 or switch the low-voltage input terminal to an electrical floating state.

The display panel 150 can be manufactured based on a hard or flexible substrate such as a glass, silicon or polyimide substrate. Sub-pixels emitting light can include red, green, and blue sub-pixels or red, green, blue, and white sub-pixels. Each sub-pixel SP can include a sub-pixel circuit PC including a switching transistor SW, a driving transistor, a storage capacitor, and an organic light-emitting diode. A specific configuration of the sub-pixel circuit PC will be described in more detail later.

Although the timing controller 120, the scan driver 130, and the data driver 140 have been described as separate components, at least one of the timing controller 120, the scan driver 130, and the data driver 140 can be integrated in an IC according to an OLED implementation method.

Figure 3:
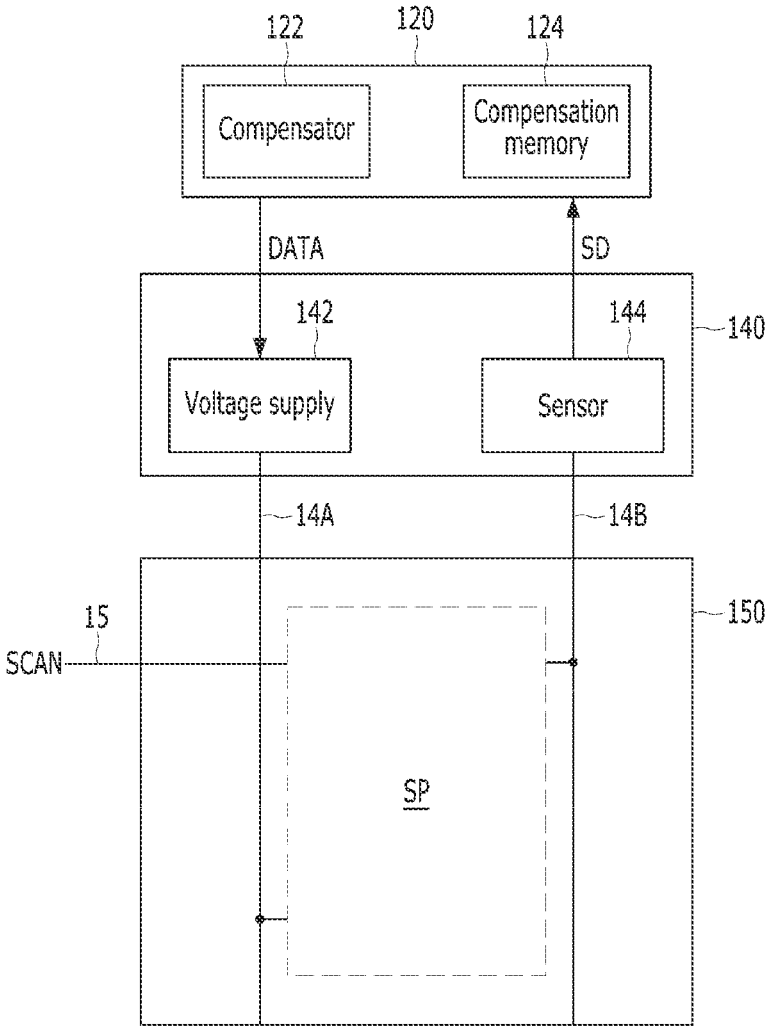
FIG. 3 is a diagram schematically illustrating a configuration of an external compensation circuit using a timing controller and a data driver according to an embodiment of the present disclosure.

FIG. 3 is a diagram schematically illustrating a configuration of an external compensation circuit using the timing controller 120 and the data driver 140 according to an embodiment of the present disclosure.

Referring to FIG. 3, the timing controller 120 includes a compensation memory 124 in which sensing data SD for data compensation is stored, and a compensator 122 for compensating for a data signal DATA to be written to the sub-pixels SP on the basis of the sensing data SD.

The timing controller 120 can control overall operation for the sensing mode according to a predetermined sensing process. For example, the sensing mode can be executed in a state in which only the screen of the display device is turned off while system power is applied, for example, in a standby mode, a sleep mode, and a power saving mode. However, the present disclosure is not limited thereto.

The compensator 122 corrects the data signal DATA to be written to the sub-pixels SP on the basis of the sensing data SD stored in the compensation memory 124 and then outputs the corrected data signal DATA to the data driver 140.

The data driver 140 includes a voltage supply 142 that outputs a data voltage to be written to the sub-pixels SP and a sensor 144 that senses characteristics of elements included in the sub-pixels SP.

The voltage supply 142 can output a data voltage for display or a data voltage for sensing through the data lines 14A. The voltage supply 142 includes a digital-to-analog converter (DAC) that converts a digital signal into an analog signal and generates the data voltage for display or the data voltage for sensing. The voltage supply 142 generates the data voltage for display in response to the data timing control signal DDC provided by the timing controller 120 during operation of the display. The voltage supply 142 supplies the data voltage for display to the data lines 14A. The data voltage for display supplied to the data lines 14A is applied to the sub-pixels SP in synchronization with a turn-on timing of a scan signal SCAN for display during operation of the display.

In the sensing mode, the voltage supply 142 can generate and apply the first data voltage for causing the driving TFTs included in the sub-pixels SP to operate source followers and the second data voltage for causing the driving TFTs to operate as switches. The first data voltage and the second data voltage can be set depending on characteristics of the driving TFTs of the sub-pixels SP, levels of the high-level voltage EVDD and the low-level voltage EVSS, and the like. For example, the first data voltage can be set to 5 V, and the second data voltage can be set to 16 V.

The sensor 144 senses characteristics of elements included in the sub-pixels SP through the sensing lines 14B. The sensor 144 can sense a sensing node defined between the source electrode of the driving TFT and the cathode of an OLED (organic light emitting diode) included in each sub-pixel SP. The sensor 144 senses and samples the sensing node of each sub-pixel SP, converts a sampling result through an analog-to-digital converter (ADC), and outputs the converted sampling result to the timing controller 120.

The sensing mode can be executed in a vertical blank period during operation of the display, in a power on sequence period before operation of the display, or in a power off sequence period after operation of the display, but the present disclosure is not limited thereto. The vertical blank period is a period in which input image data is not written and is disposed between vertical active periods in which input image data corresponding to one frame. The power on sequence period means a transition period from when driving power is on to when an input image is displayed. The power off sequence period means a transition period from when display of an input image ends to when the driving power is off.

Figure 4:
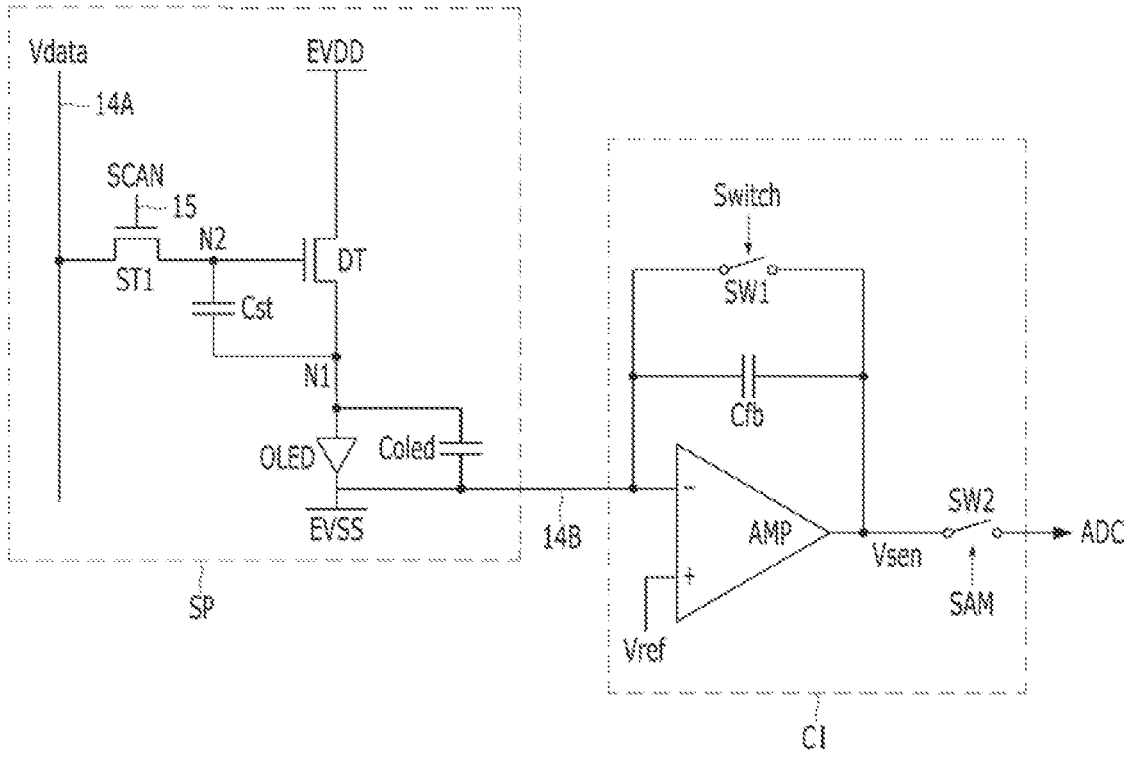
FIG. 4 is a diagram illustrating a schematic configuration of the sub-pixel and a sensor according to an embodiment of the present disclosure.
Figure 5:
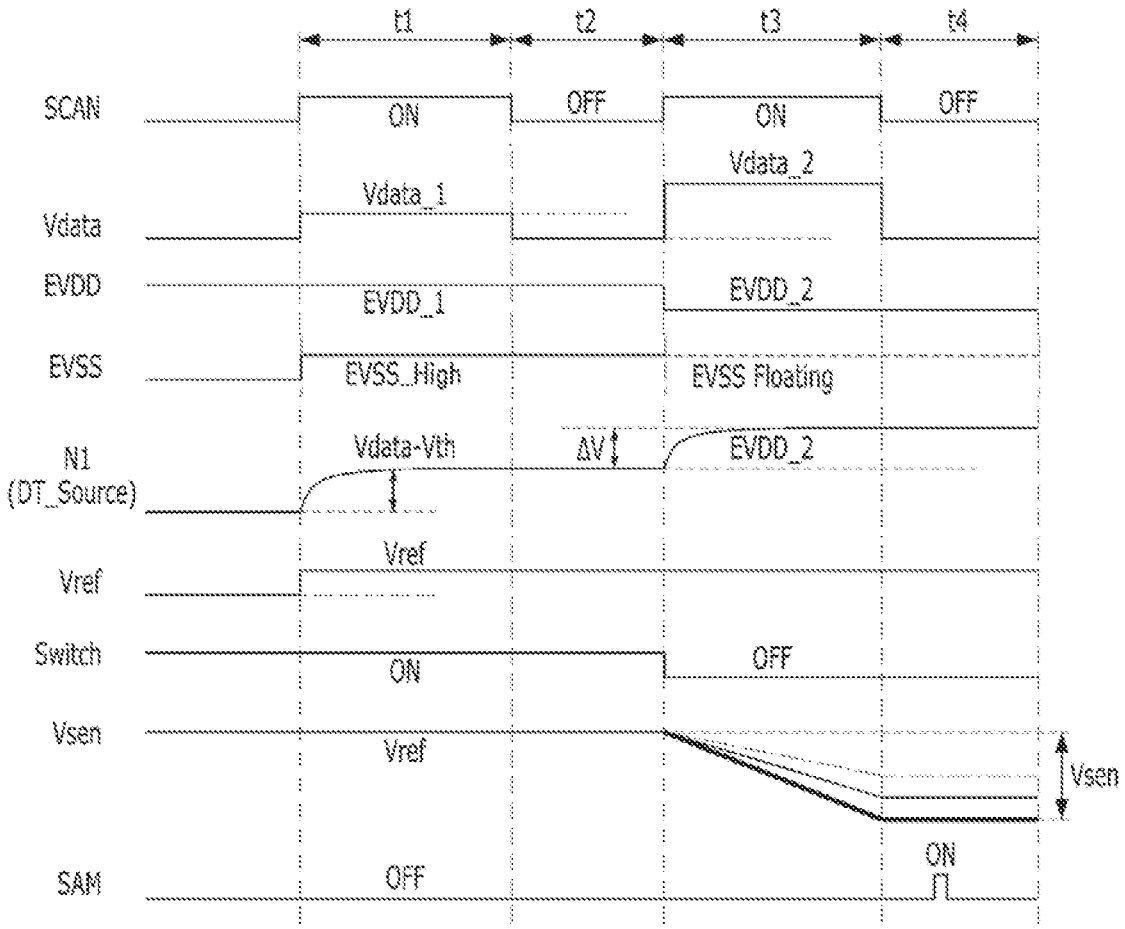
FIG. 5 is a diagram illustrating waveforms of driving signals applied for current sensing an output voltage according to a current sensing result.

FIG. 4 is a diagram illustrating a schematic configuration of the sub-pixel SP and the sensor 144 connected to the sub-pixel SP according to an embodiment of the present disclosure, and FIG. 5 is a diagram illustrating waveforms of driving signals applied to the circuit of FIG. 4 for current sensing and an integral value according to a current sensing result.

Referring to FIG. 4, the sub-pixel SP according to an embodiment of the present disclosure can be configured in a 2T1C structure including an OLED, a driving thin film transistor (TFT) DT, a storage capacitor Cst, and a first switch TFT ST1.

The OLED includes an anode connected to a first node N1, a cathode connected to an input terminal for the low-level voltage EVSS, and an organic compound layer provided between the anode and the cathode. A parasitic capacitor Coled is generated in the OLED due to the anode, the cathode, and a plurality of insulating films present therebetween. The OLED parasitic capacitor Coled has capacitance of several pF which is much less than parasitic capacitance of hundreds to thousands pF existing on the sensing lines 14B.

The first switch TFT ST1 applies a data voltage Vdata on the data line 14A to a second node N2 in response to a scan signal SCAN. The first switch TFT ST1 includes a gate electrode connected to the gate line 15, a drain electrode connected to the data line 14A, and a source electrode connected to the second node N2.

The driving TFT DT includes a gate electrode connected to the second node N2, a drain electrode connected to an input terminal for the high-level voltage EVDD, and a source electrode connected to the first node N1. The storage capacitor Cst is connected between the first node N1 and the second node N2.

In the display mode, the driving TFT DT receives the data voltage Vdata through the second node N2 and controls the quantity of current input to the OLED according to a gate-source voltage Vgs.

In the sensing mode, the driving TFT DT can operate in a saturation mode in which it operates as a source follower or operate as a switch that applies the high-level voltage EVDD applied to the drain electrode to the source electrode according to the data voltage Vdata input to the second node N2. For example, the driving TFT DT can operate in the saturation mode when the data voltage is about 5 V and operate in a switch mode when the data voltage is sufficiently high, for example, 16 V.

In a period in which the driving TFT DT operates in the saturation mode, the first high-level voltage EVDD_1 is applied to the drain electrode of the driving TFT DT and the low-level voltage EVSS_High higher than a voltage supplied in the display mode is applied to the cathode of the OLED. Accordingly, it is possible to prevent driving power from being applied to the OLED due to operation of the driving TFT DT.

In a period in which the driving TFT DT operates in the switch mode, the second high-level voltage EVDD_2 lower than the first high-level voltage EVDD_1 is applied to the drain electrode of the driving TFT DT and the cathode of the OLED is electrically floating. Accordingly, the voltage of the source node of the driving TFT DT can increase from the previously saturated voltage to the second high-level voltage EVDD_2.

The sensor 144 senses a current Ids flowing between the source and the drain of the driving TFT DT when the driving TFT DT operates in the switch mode. Accordingly, the sensor 144 can include a current integrator CI that senses and samples the current Ids of the driving TFT DT and an analog-to-digital converter (ADC) that converts a sensing voltage sampled by the current integrator CI into a digital sensing value and outputs the digital sensing value.

The current integrator CI can include an amplifier AMP including an inverted input terminal (−) through which the source-drain current Ids of the driving TFT is input from the sensing line 14B connected to the source node of the driving TFT DT, a non-inverted input terminal (+) through which a reference voltage Vref is input, and an output terminal through which an integral value Vsen is output, an integral capacitor Cfb connected between the inverted input terminal (−) and the output terminal of the amplifier AMP, a first switch SW1 connected between both ends of the integral capacitor Cfb, and a second switch SW2 that switches in response to a sampling signal SAM.

Referring to FIG. 5, the sensing mode can include first to fourth periods t1 to t4. Each process performed in the sensing mode can be executed according to control of the timing controller 120. The driving TFT DT operates in the saturation mode in the first period t1 and a saturated voltage is held in the source node of the driving TFT DT in the second period t2 according to a signal input under the control of the timing controller 120. In the third period t3, the driving TFT DT operates in the switch mode and the current integrator CI detects the current Ids of the driving TFT DT and outputs a sensing voltage Vsen. In the fourth period t4, the sensing voltage Vsen of the current integrator CI is sampled and output to the ADC.

To perform such a sensing mode operation, the scan signal SCAN can be supplied to the gate electrode of the first switch TFT ST1 to turn on/off the first switch TFT ST1. The scan signal SCAN is supplied at an on level in the first period t1 and the third period t3 and supplied at an off level in the second period t2 and the fourth period t4. Accordingly, the first switch TFT ST1 can be turned on to electrically connect the data line 14A and the driving TFT DT in the first period t1 and the third period t3.

The data signal Vdata is supplied through the data line 14A. The data signal Vdata is applied as a first data signal Vdata_1 in the first period t1 and applied as a second data signal Vdata_2 in the third period t3. The first data signal Vdata_1 can be set to 5 V and the second data signal Vdata_2 can be set to 16 V.

The high-level voltage EVDD is applied as the first high-level voltage EVDD_1 in the first period t1 and the second period t2 and is applied as the second high-level voltage EVDD_2 in the third period t3 and the fourth period t4. The first high-level voltage EVDD_1 can be a voltage supplied when the sub-pixel is driven in the display mode. The first high-level voltage EVDD_1 has a sufficiently high level to provide a driving voltage of the driving TFT applied across the source and drain electrodes of the driving TFT and a driving voltage of the OLED. For example, the first high-level voltage EVDD_1 can be set to 24 V. The second high-level voltage EVDD_2 is set to a voltage level sufficient to be transmitted to the source node N1 through the turned on driving TFT DT in the sensing operation. The second high-level voltage EVDD_2 is a voltage adjusted to be lower than the first high-level voltage EVDD_1 and can be set to 10 V, for example.

The low-level voltage EVSS is applied as the low-level voltage EVSS_High higher than a voltage supplied in the display mode in the first period t1 and the second period t2 such that current can be prevented from being applied to the OLED. The low-level voltage EVSS is electrically floating in the third period t3 and the fourth period t4 such that the low-level voltage EVSS can be prevented from being applied to the sensing line 14B.

The voltage of the first node N1, which is the voltage of the source node of the driving TFT, varies as the driving TFT operates according to the data signal Vdata and the high-level voltage EVDD applied in the first to fourth periods t1 to t4. In the first period t1, the voltage of the first node N1 increases and is saturated at a point in time at which a difference Vgs between the gate voltage and the source node voltage of the driving TFT reaches a threshold voltage Vth of the driving TFT. The saturated voltage has a level of Vdata_1−Vth. In the second period t2, the voltage of the first node N1 is maintained as the saturated voltage. In the third period t3, the voltage of the first node N1 increases from the previously saturated voltage and is saturated at a point in time at which it reaches the second high-level voltage EVDD_2. In the fourth period t4, the voltage of the first node N1 is maintained as the saturated voltage.

The reference voltage Vref input to the non-inverted terminal (+) of the amplifier AMP is maintained as a specific reference voltage Vref. For example, 11 V can be input as the reference voltage Vref.

A switch signal Switch can be used to turn on/off the first switch SW1 connected between both ends of the integral capacitor Cfb. The switch signal Switch is applied at an on level in the first period t1 and the second period t2 and is applied at an off level in the third period t3 and the fourth period t4.

The output voltage Vsen of the amplifier AMP is determined according to whether the first switch SW1 connected between both ends of the integral capacitor Cfb is turned on or off, a voltage input to the inverted input terminal (−) of the amplifier AMP, and the reference voltage Vref. Accordingly, the output voltage Vsen of the amplifier AMP is maintained as the reference voltage Vref in the first period t1 and the second period t2 in which the first switch SW1 is turned on. The output voltage Vsen of the amplifier AMP decreases in response to change in the voltage input to the inverted input terminal (−) in the third period t3 and the fourth period t4 in which the first switch SW1 is turned off.

The sampling signal SAM can be used to turn on/off the second switch SW2. The sampling signal SAM is applied at an on level in the fourth period t4 to sample the output voltage Vsen of the amplifier AMP.

The circuit operation in the first to fourth periods t1 to t4 in which the sensing operation is performed on the basis of the above-described operation waveforms will be described in detail.

FIG. 6 to FIG. 9 are diagrams for describing the sensing operation in the first to fourth periods t1 to t4 according to an embodiment of the present disclosure.

Figure 6:
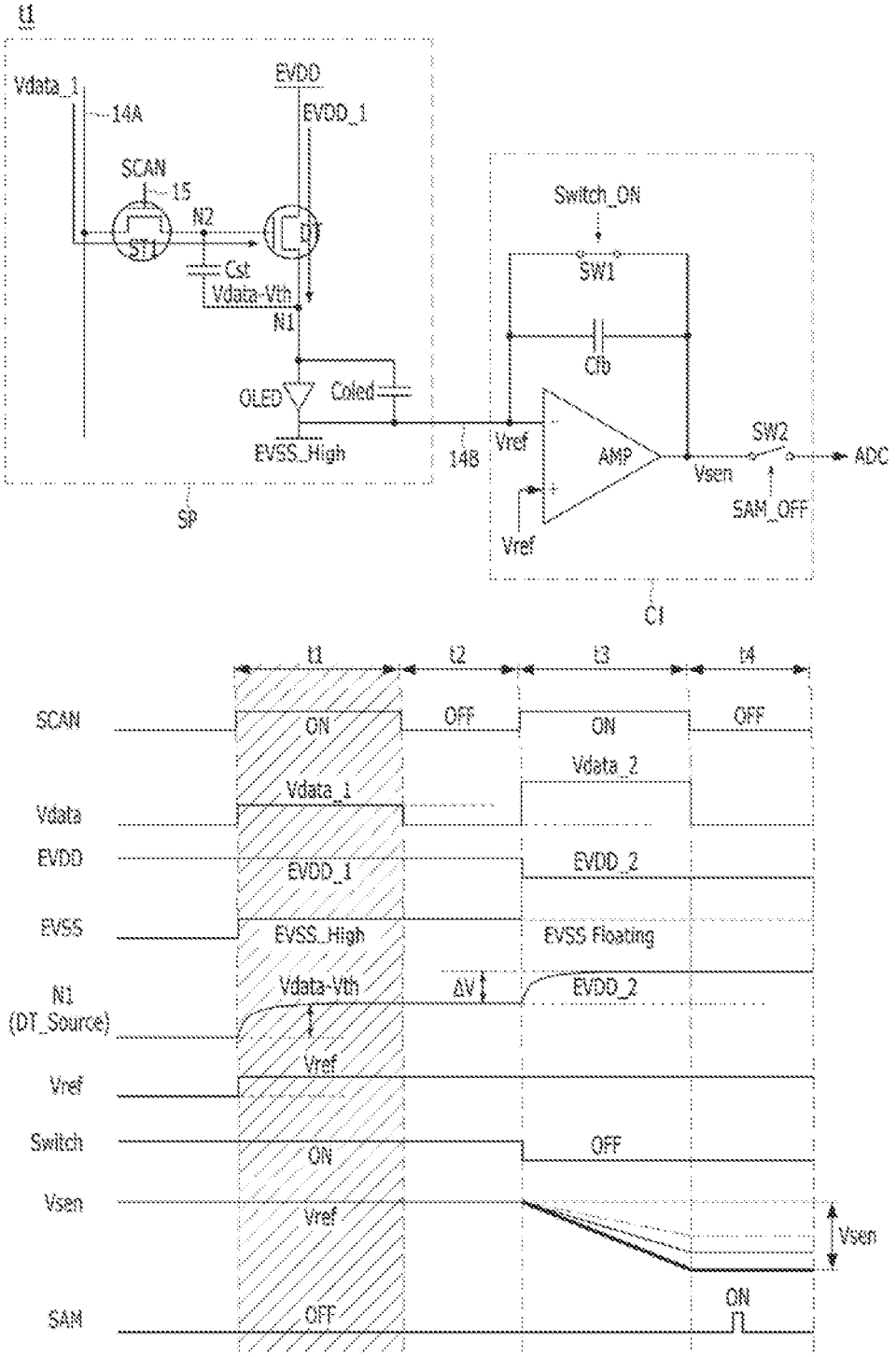
FIG. 6 to FIG. 9 are diagrams for describing a sensing operation according to an embodiment of the present disclosure.

More specifically, FIG. 6 is a diagram for describing the sensing operation in the first period t1.

Referring to FIG. 6, in the first period t1, the scan signal SCAN is supplied at an on level to turn on the first switch TFT ST1. Accordingly, the first data signal Vdata_1 input through the data line 14A is applied to the second node N2. Here, it is assumed that the second node N2 is the gate node of the driving TFT DT and the first node N1 is the source node of the driving TFT DT. In addition, it is assumed that the source node of the driving TFT DT is the sensing node in the corresponding sub-pixel SP.

The first data signal Vdata_1 is applied to the gate electrode of the driving TFT DT and the first high-level voltage EVDD_1 is applied to the drain electrode thereof. The low-level voltage EVSS_High higher than a voltage supplied in the display mode is applied as the low-level voltage EVSS. Accordingly, it is possible to prevent driving power from being applied to the OLED.

The driving TFT DT operates in the saturation mode and thus a driving current flows according to a difference Vgs between voltages of the gate electrode and the source electrode. Since the first data signal Vdata_1 is applied to the gate electrode, the current Ids flows between the source and drain electrodes of the driving TFT DT to cause the voltage of the first node N1 to increase. The current Ids of the driving TFT DT becomes zero at a point in time at which the gate-source voltage Vgs of the driving TFT DT reaches the threshold voltage Vth of the driving TFT. Accordingly, the potential of the source electrode of the driving TFT DT is saturated. Boosting of the voltage of the source node of the driving TFT DT to the voltage of the gate electrode of the driving TFT DT is called "source following". The voltage saturated at the first node N1 according to source following has a voltage level of Vdata_1−Vth.

A specific reference voltage Vref is input to the non-inverted input terminal (+) of the amplifier AMP of the sensor 144 and the switch signal Switch is applied at a turn-on level, and thus the first switch SW1 connected between both ends of the integral capacitor Cfb is turned on. The turned on first switch SW causes the amplifier AMP to operate as a unit gain buffer having a gain of 1. Accordingly, the output voltage Vsen of the amplifier AMP is maintained as the reference voltage Vref.

Figure 7:
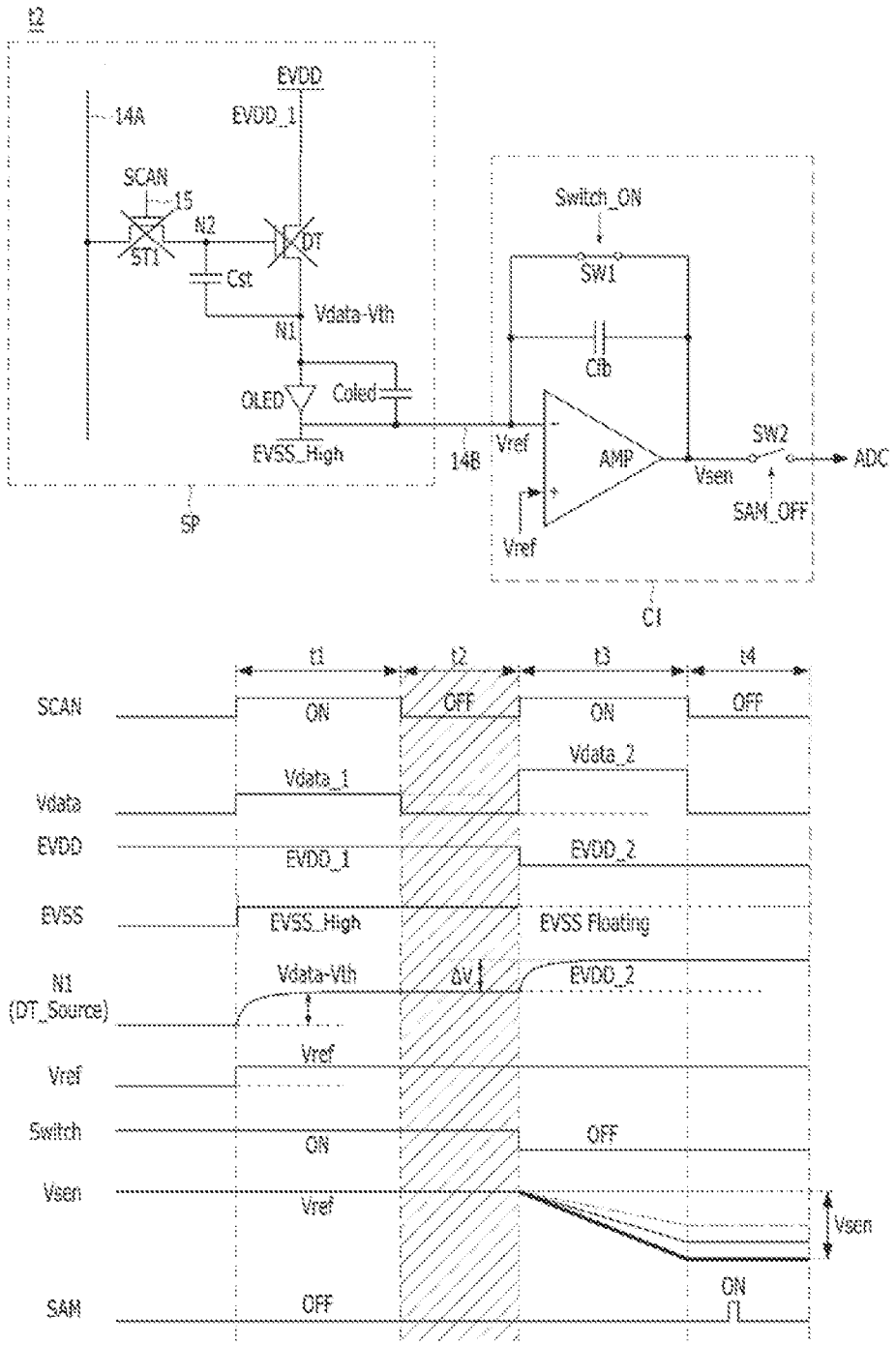

FIG. 7 is a diagram for describing the sensing operation in the second period t2.

Referring to FIG. 7, the scan signal SCAN is applied at an off level in the second period t2 and thus the first switch TFT ST1 is turned off and the data signal Vdata is not applied. Accordingly, the driving TFT DT is turned off and the voltage of the first node N1 is maintained as the voltage Vdata_1−Vth saturated in the first period t1.

The switch signal Switch of the sensor 144 is applied at the turn-on level and thus the first switch SW1 connected between both ends of the integral capacitor Cfb is turned on. Since the turned on first switch SW causes the amplifier AMP to operate as a unit gain buffer having a gain of 1, the output voltage Vsen of the amplifier AMP is maintained as the reference voltage Vref.

Figure 8:
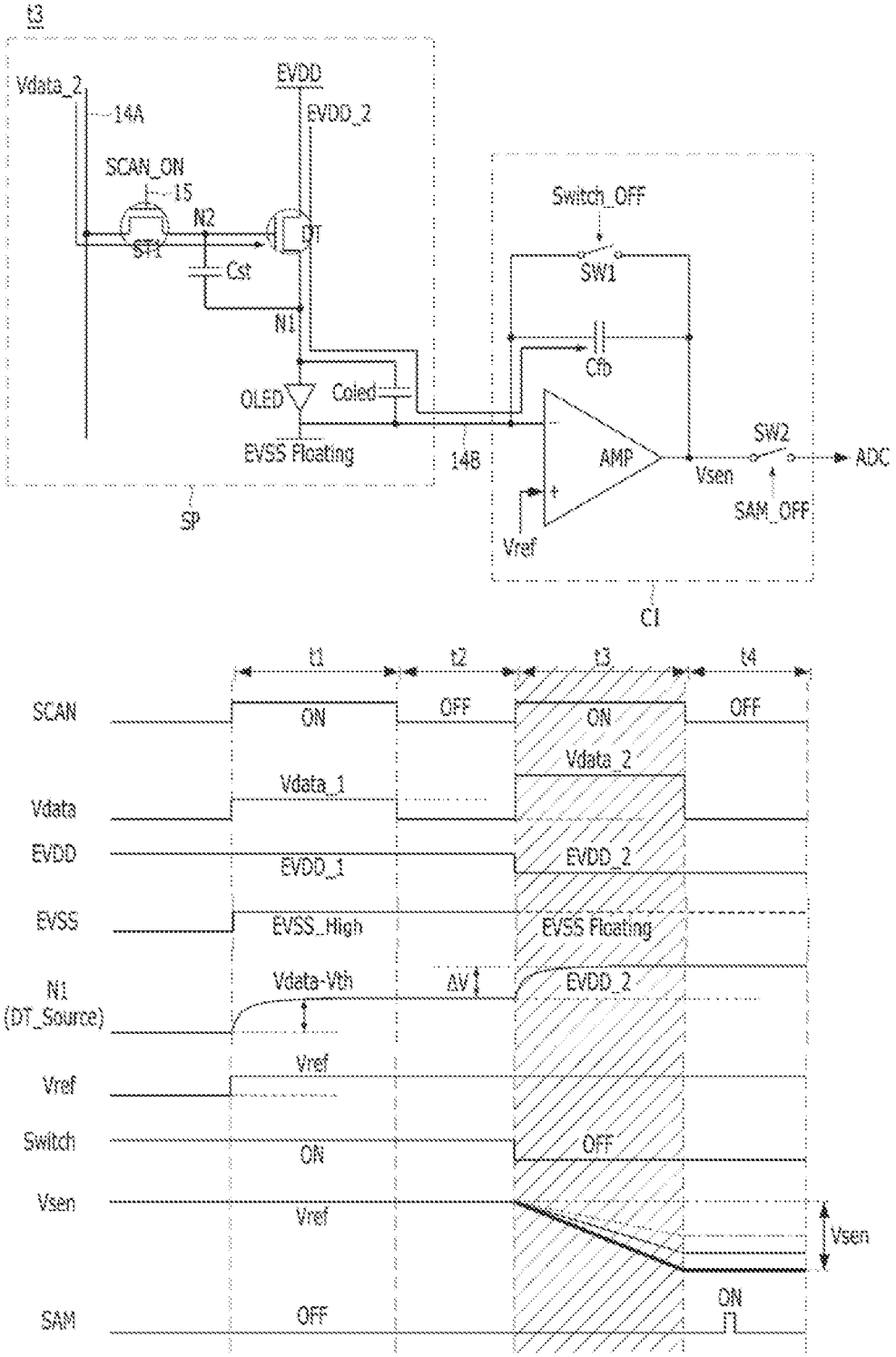

FIG. 8 is a diagram for describing the sensing operation in the third period t3.

Referring to FIG. 8, in the third period t3, the scan signal SCAN is applied at the on level and thus the first switch TFT ST1 is turned on. The second data signal Vdata_2 is applied to the gate electrode of the driving TFT DT. Since the second data signal Vdata_2 has a high voltage level sufficient to turn on the driving TFT DT, the driving TFT DT operates in the switch mode. The second data signal Vdata_2 can be set to about 16 V.

The second data signal Vdata_2 is applied to the gate electrode of the driving TFT DT and the second high-level voltage EVDD_2 is applied to the drain electrode thereof. The second high-level voltage EVDD_2 is set to a voltage level sufficient to be transmitted to the source node N1 through the turned on driving TFT DT. Accordingly, the second high-level voltage EVDD_2 can be set to a voltage adjusted to be lower than the first high-level voltage EVDD_1 or the second high-level voltage EVDD_2 can be maintained as the first high-level voltage EVDD_1 and the reference voltage Vref can increase. For example, the second high-level voltage EVDD_2 can be set to 10 V adjusted to be lower than the first high-level voltage EVDD_1. In this case, power consumption can be reduced. The low-level voltage EVSS switches to a floating state.

The driving TFT DT is turned on by the second data signal Vdata_2 input to the gate electrode to cause the current Ids to flow between the source and drain electrodes. Accordingly, the voltage of the first node N1 increases and is saturated at the second high-level voltage EVDD_2. Here, the voltage of the first node N1 increases from the voltage Vdata_1−Vth charged in the first period t1 to the second high-level voltage EVDD_2. Accordingly, voltage variation ΔV increases as the threshold voltage Vth increases.

The sensor 144 can execute a sensing function in the third period t3. In the third period t3, the switch signal Switch is applied at the off level and thus the first switch SW1 connected between both ends of the integral capacitor Cfb is turned off. Since the first switch SW1 is turned off, the amplifier AMP operates as the current integrator CI to integrate the current Ids of the driving TFT DT which flows to the first node N1.

Since the inverted input terminal (−) and the non-inverted input terminal (+) of the amplifier AMP are short-circuited through a virtual ground and thus have a potential difference of 0 therebetween due to characteristics of the amplifier AMP, the potential of the inverted input terminal (−) is maintained as the reference voltage Vref irrespective of potential difference increase in the integral capacitor Cfb in the third period t3. Instead, the output voltage Vsen of the amplifier AMP decreases in response to a potential difference between both ends of the integral capacitor Cfb. For example, as the voltage variation ΔV is applied to the non-inverted input terminal (+), the output voltage Vsen of the amplifier AMP decreases. The voltage variation ΔV increases as the threshold voltage Vth increases, and descent gradient of the output voltage Vsen of the amplifier AMP increases as the voltage variation ΔV increases. Consequently, the output voltage Vsen decreases as the threshold voltage Vth increases.

Figure 9:
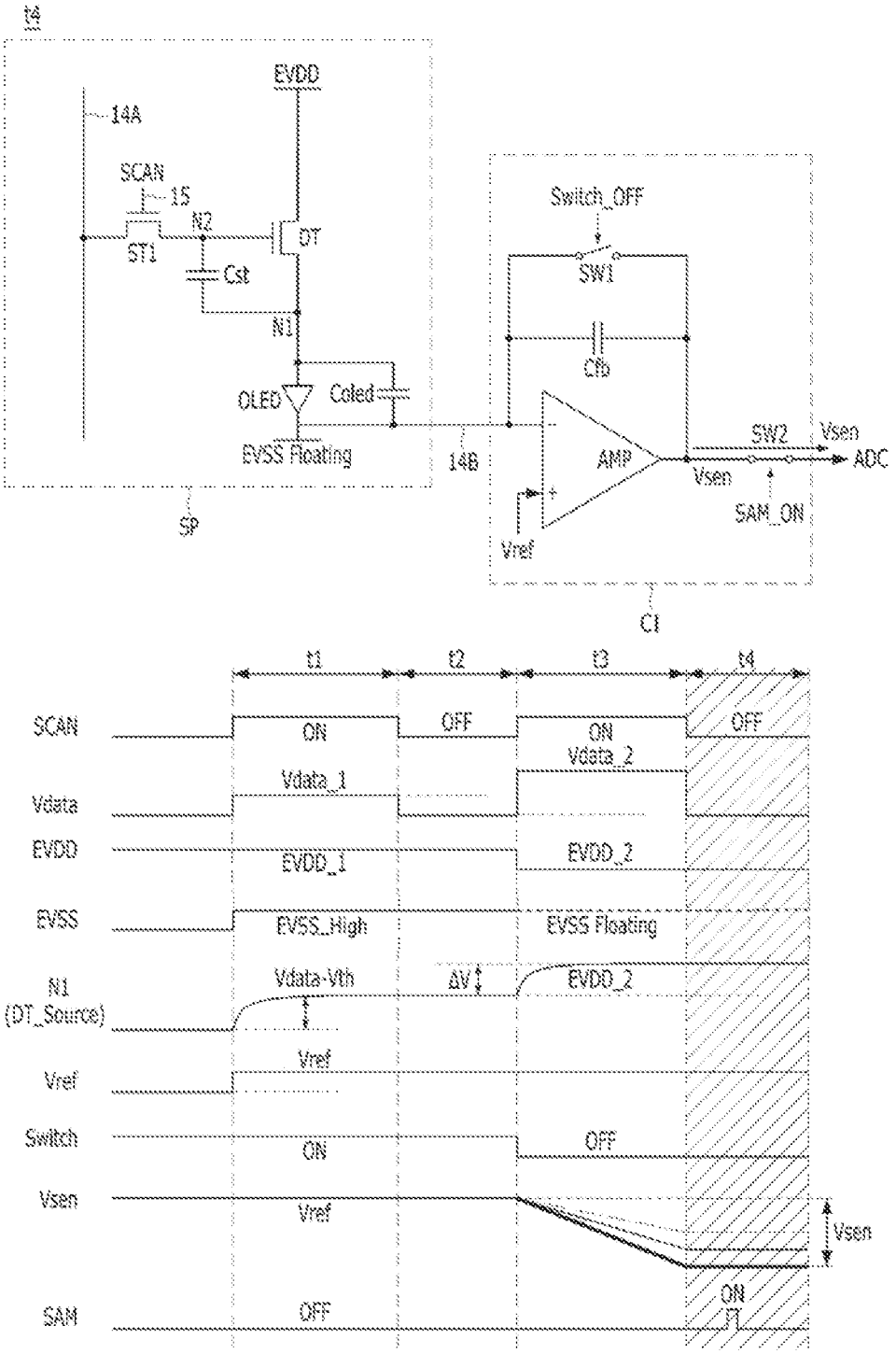

FIG. 9 is a diagram for describing the sensing operation in the fourth period t4.

Referring to FIG. 9, the output voltage Vsen is sampled in the fourth period t4. The scan signal SCAN is supplied at the off level and thus the first switch TFT ST1 is turned off and the data signal Vdata is not applied in the fourth period t4. Accordingly, the driving TFT DT is turned off and the voltage of the first node N1 is maintained as the second high-level voltage EVDD_2 to which the voltage has been saturated in the third period t3.

The switch signal Switch of the sensor 144 is applied at the off level and thus the amplifier AMP operates as the current integrator CI and the output voltage Vsen of the amplifier AMP is reduced by the voltage variation ΔV.

In the fourth period t4, a sampling signal SAM_OM at an on level is applied to sample the output voltage Vsen. The second switch SW2 is turned on upon reception of the sampling signal SAM_OM at the on level, and thus the output voltage Vsen is input to the ADC.

The output voltage Vsen sampled in the fourth period t4 is converted into a digital sensing value SD by the ADC and then transmitted to the timing controller 110. The digital sensing value SD is used for the timing controller 110 to derive threshold voltage deviation ΔVth and mobility deviation ΔK of the driving TFT.

The capacitance of the integral capacitor Cfb, the reference voltage Vref, and a sensing time value ΔT are stored as digital code in advance in the timing controller 110. Accordingly, the timing controller 110 can calculate the source-drain current (Ids=Cfb*ΔV/ΔT). Here, ΔV=Vref−Vsen flowing through the driving TFT DT from the digital sensing value SD that is digital code for the integral value Vsen. The timing controller 110 applies the digital sensing value SD to a compensation algorithm to derive the deviation values ΔVth and AK and compensation data for compensating for the deviations. The compensation algorithm can be implemented as a look-up table or an operation logic.

The following formulas can be applied to calculate the threshold voltage deviation and the mobility deviation using the source-drain current Ids flowing through the driving TFT DT.

$$Id = \frac{1}{2} uCox \frac{W}{L} (Vgs - Vth)^2 \quad \text{⟨Formula⟩}$$

$$Id = \alpha (Vdata - VpreS - Vth)^2$$

$$Id = C \frac{dv}{dt}$$

$$\alpha = \frac{dv * C}{dt * (Vdata - VpreS - Vth)^2}$$

In the formulas, μ represents electron mobility, C represents capacitance of a gate insulating layer, W represents the channel width of the driving TFT, and L represents the channel length of the driving TFT. In addition, Vgs represents the gate-source voltage of the driving TFT, and Vth represents the threshold voltage of the driving TFT. Vdata applied to calculate α is substituted with Vdata_2 and VpreS is substituted with Vdata_1. The timing controller 110 can generate the compensation data for deviation compensation by calculating the threshold voltage deviation and the mobility deviation using the above formulas.

The above-described sensing method according to an embodiment of the present disclosure can be performed using the current integrator CI. The capacitance of the integral capacitor Cfb included in the current integrator CI is several hundredth of parasitic capacitance existing on a sensing line, and thus a time taken to cause the current Ids to flow to obtain the integral value Vsen that can be sensed is significantly reduced in the current sensing method of the present disclosure, as compared to a conventional voltage sensing method. Furthermore, sensing time considerably increases in the conventional voltage sensing method because the source voltage of the driving TFT is saturated and then the saturated voltage is sampled as a sensing voltage at the time of sensing the threshold voltage, whereas sensing time can be considerably reduced in the current sensing method of the present disclosure because the source-drain current of the driving TFT can be integrated and the integral value can be sampled within a short time through current sensing at the time of sensing the threshold voltage and mobility.

Particularly, the driving TFT is caused to operate in the saturation mode by adjusting only EVDD and the voltage of gate input data without an additional sensing TFT to obtain a value Vdata-Vth and then the driving TFT is caused to operate in the switch mode to sense the sensing voltage Vsen according to Vth in the sensing operation, and thus the pixel structure can be simplified as the 2T1C structure.

Figure 10:
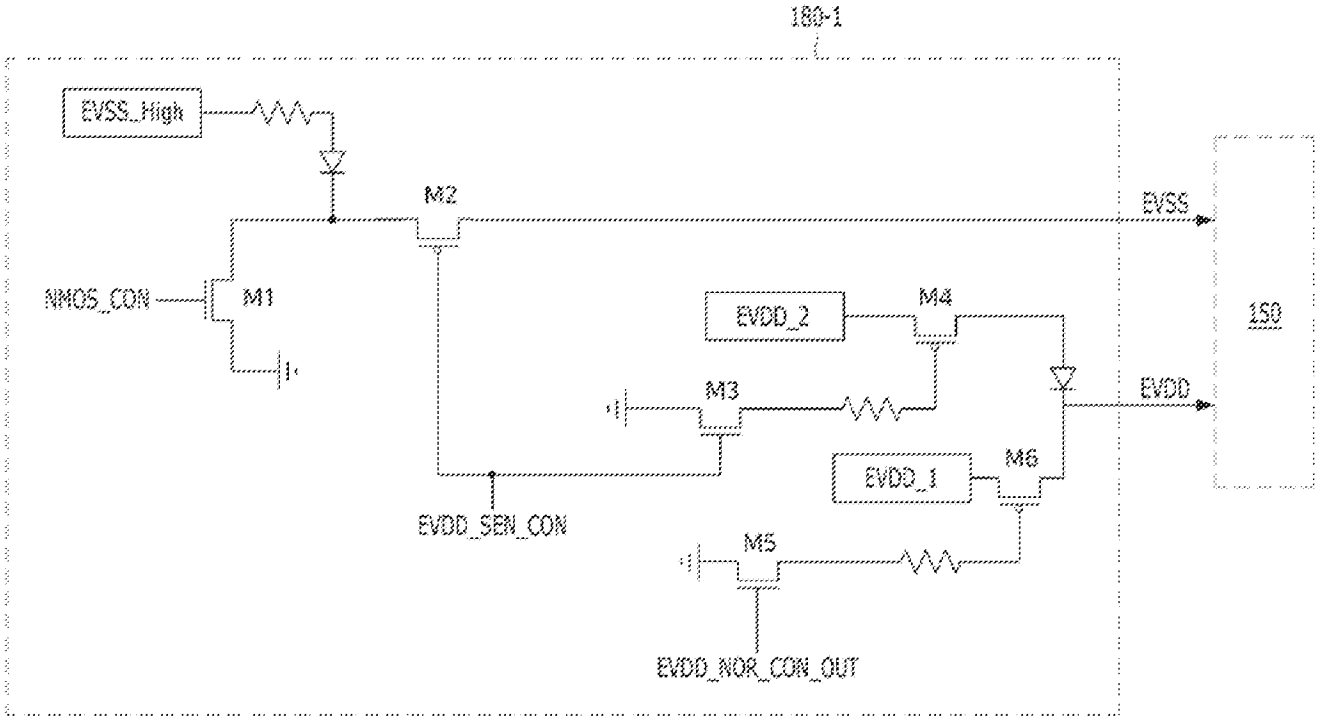
FIG. 10 is a diagram for describing a configuration of a power supply according to a first embodiment of the present disclosure.

FIG. 10 is a diagram for describing a configuration of a power supply 180-1 according to a first embodiment of the present disclosure.

Referring to FIG. 10, although the power supply 180 can generate voltages at various levels necessary to operate the display device, such as the high-level voltage EVDD, the low-level voltage EVSS, the high scan voltage, and the high low voltage, only a configuration for supplying the high-level voltage EVDD and the low-level voltage EVSS will be described in the present embodiment.

When the sensing operation according to the embodiment of the present disclosure is performed, the high-level voltage EVDD is applied as the first high-level voltage EVDD_1 in the first period t1 and the second period t2 and is applied as the second high-level voltage EVDD_2 in the third period t3 and the fourth period t4. The low-level voltage EVSS is applied as the low-level voltage EVSS_High higher than a voltage supplied in the display mode in the first period t1 and the second period t2 and is floating in the third period t3 and the fourth period t4.

To perform this operation, the power supply 180-1 according to the first embodiment of the present disclosure includes a first high-level voltage (EVDD_1) generator, a second high-level voltage (EVDD_2) generator, a low-level voltage (EVSS_High) generator, and a plurality of switches M1 to M6 that switch according to an input control signal such that the output voltage of each voltage generator is applied to the display panel 150.

The switches M1 to M6 can be connected to power lines to which the voltages of the voltage generators are applied and can form a power path through which the voltages are applied to the display panel 150 by connecting/disconnecting the power lines.

The low-level voltage (EVSS_High) generator is connected to an EVSS supply line in the first period t1 and the second period t2 and is connected to the ground GND in the third period t3 and the fourth period t4. The second switch M2 is provided on the connection line of the EVSS supply line and the low-level voltage (EVSS_High) generator and the first switch M1 is provided on the connection line of the EVSS supply line and the ground GND.

The second switch M2 is turned on in response to a first switching signal EVDD_SEN_CON in the first period t1 and the second period t2 to cause the low-level voltage EVSS_High to be applied to the EVSS supply line. The second switch M2 is turned off in response to the first switching signal EVDD_SEN_CON in the third period t3 and the fourth period t4 to block the low-level voltage EVSS_High from being applied to the EVSS supply line. When the second switch M2 is configured as a PMOS TFT, the first switching signal EVDD_SEN_CON can be supplied as a logic low signal L in the first period t1 and the second period t2 and supplied as a logic high signal H in the third period t3 and the fourth period t4.

The first switch M1 is turned on in response to a second switching signal NMOS_CON in the display mode in which the display panel 150 displays an image and turned off in the sensing mode, for example, in the first to fourth periods t1 to t4. Accordingly, the low-level voltage (EVSS_High) generator is connected to the ground GND in the display mode and is disconnected from the ground GND in the sensing mode. When the first switch M1 is configured as an NMOS TFT, the second switching signal NMOS_CON can be supplied as a logic log signal L in the first to fourth periods t1 to t2.

The first high-level voltage (EVDD_1) generator and the second high-level voltage (EVDD_2) generator are connected to an EVDD supply line through which the high-level voltage EVDD is supplied to the display panel 150. The first high-level voltage (EVDD_1) generator is connected to the EVDD supply line in the first period t1 and the second period t2 and the second high-level voltage (EVDD_2) generator is connected to the EVDD supply line in the third period t3 and the fourth period t4.

The sixth switch M6 is provided on the connection line of the first high-level voltage (EVDD_1) generator and the EVDD supply line and the fourth switch M4 is provided on the connection line of the second high-level (EVDD_2) generator and the EVDD supply line.

The sixth switch M6 is turned on to cause the first high-level voltage EVDD_1 to be applied to the EVDD supply line in the first period t1 and the second period t2 and turned off to block the first high-level voltage EVDD_1 from being applied to the EVDD supply line in the third period t3 and the fourth period t4. The on/off operation of the sixth switch M6 can be controlled by the on/off operation of the fifth switch M5 controlled by a third switching signal EVDD_NOR_COUN_OUT.

The fifth switch M5 is turned on according to the third switching signal EVDD_NOR_COUN_OUT such that an on-level switching signal is applied to the sixth switch M6 in the first period t1 and the second period t2. When the sixth switch M6 is configured as a PMOS TFT, the fifth switch M5 can cause the on-level switching signal to be applied to the sixth switch M6 by connecting the gate electrode of the sixth switch M6 to the ground GND.

The fourth switch M4 is turned on such that the second high-level voltage EVDD_2 is applied to the EVDD supply line in the third period t3 and the fourth period t4 and turned off to block the second high-level voltage EVDD_2 from being applied to the EVDD line in the first period t1 and the second period t2. The on/off operation of the fourth switch M4 can be controlled by the on/off operation of the third switch M3 controlled according to the first switching signal EVDD_SEN_CON.

The third switch M3 is turned on according to the first switching signal EVDD_SEN_CON such that an off-level switching signal is applied to the fourth switch M4 in the first period t1 and the second period t2. When the fourth switch M4 is configured as a PMOS TFT, the third switch M3 can cause the on-level switching signal to be applied to the fourth switch M4 by connecting the gate electrode of the fourth switch M4 to the ground GND. The third switch M3 can be turned on according to the first switching signal EVDD_SEN_CON such that the on-level switching signal is applied to the fourth switch M4 in the third period t3 and the fourth period t4.

Since the low-level voltage EVSS_High higher than a voltage supplied in the display mode needs to be applied when the second high-level voltage EVDD_2 is applied, the third switch M3 that determines whether to apply the second high-level voltage EVDD_2 and the second switch M2 that determines whether to apply the low-level voltage EVSS_High can share the first switching signal EVDD_SEN_CON.

Figure 11:
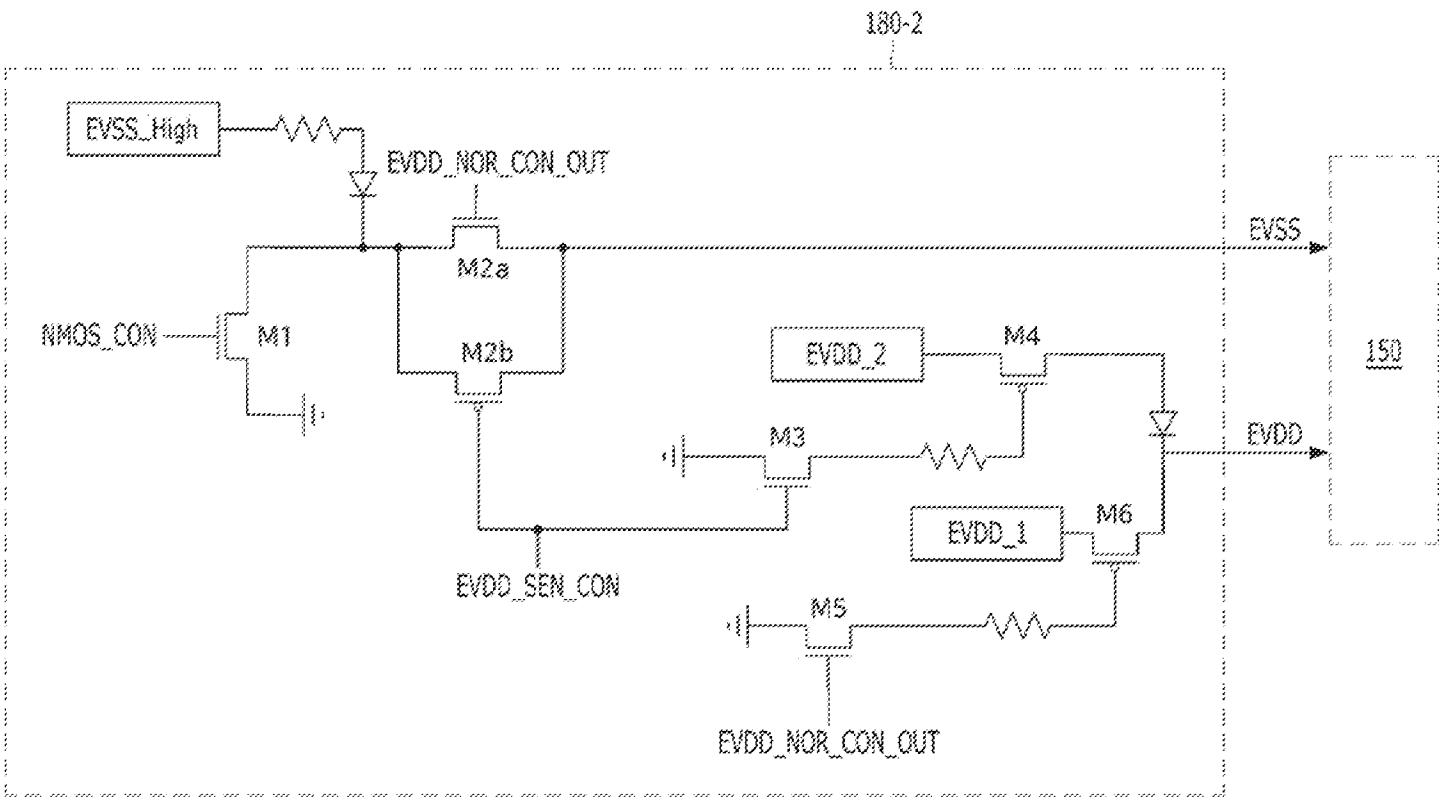
FIG. 11 is a diagram for describing a configuration of a power supply according to a second embodiment of the present disclosure.

FIG. 11 is a diagram for describing a configuration of a power supply 180-2 according to a second embodiment of the present disclosure.

Referring to FIG. 11, the power supply 180-2 according to the second embodiment differs from the power supply 180-1 according to the first embodiment in that two second switches M2*a* and M2*b* for determining whether to apply the low-level voltage EVSS_High are provided.

The second switch M2*a* is turned on such that the low-level voltage EVSS_High is applied to the EVSS supply line in the first period t1 and the second period t2 and turned off to block the low-level voltage EVSS_High from being applied to the EVSS supply line in the third period t3 and the fourth period t4.

The second switch M2*b* is also turned on such that the low-level voltage EVSS_High is applied to the EVSS supply line in the first period t1 and the second period t2 and turned off to block the low-level voltage EVSS_High from being applied to the EVSS supply line in the third period t3 and the fourth period t4.

The second switches M2*a* and M2*b* can be different types of switches. For example, the second switch M2*a* can be an NMOS type and the second switch M2*b* can be a PMOS type. Since the low-level voltage EVSS_High higher than a voltage supplied in the display mode needs to be applied when the second high-level voltage EVDD_2 is applied, the third switch M3 that determines whether to apply the second high-level voltage EVDD_2 and the second switch M2*b* that determines whether to apply the low-level voltage EVSS_High can share the first switching signal EVDD_SEN_CON. Since the low-level voltage EVSS_High higher than a voltage supplied in the display mode needs to be blocked when the first high-level voltage EVDD_1 is applied, the fifth switch M5 that determines whether to apply the first high-level voltage EVDD_1 and the second switch M2*a* that determines whether to apply the low-level voltage EVSS_High can share the third switching signal EVDD_NOR_CON_OUT.

In the circuit configuration for accomplishing the aforementioned power supply, the switch types and connection method can be modified in various manners and applied to obtain further improved effects.

As described above, the present embodiment can increase the number of times of sensing (i.e., perform multi-sensing) in proportion to the duration of the vertical blank period even if a frame frequency varies according to an input image when electrical characteristic deviation between sub-pixels is compensated through an external compensation method to minimize compensation period delay and image quality deterioration.

It will be apparent to those skilled in the art that various modifications and variations can be made in the present disclosure without departing from the spirit or scope of the invention. Thus, the scope of the present disclosure should be determined by the appended claims and their legal equivalents, not by the above description.

The display device and the method for driving the same according to the present disclosure can reduce the complexity of the sub-pixel circuit by controlling the operation of the driving transistor to output a sensing signal without a switching transistor used for sensing, resulting in decrease in manufacturing costs. Furthermore, the present disclosure can reduce sensing time and compensation time by sensing characteristics of the driving TFT using the current integrator.

Effects which can be obtained by the present disclosure are not limited to the above-described effects, and various other effects can be evidently understood by those skilled in the art to which the present disclosure pertains from the following description.

What is claimed is:

1. A display device comprising:

a light-emitting element configured to emit light;

a driving transistor configured to provide a high-level voltage to the light-emitting element; and a switching transistor configured to transfer a voltage input through a data line to a gate node of the driving transistor, wherein the driving transistor operates in a saturation mode in which a voltage of a source node of the driving transistor is saturated in response to a first data voltage input to the gate node, and operates in a switch mode in which the driving transistor operates as a switch in response to a second data voltage higher than the first data voltage, so that a driving current generated in the driving transistor is able to be sensed through the source node.

2. The display device according to claim 1, wherein the driving transistor operates as a source follower in the saturation mode so that the source node is saturated to a voltage obtained by subtracting a threshold voltage of the driving transistor from the first data voltage, and the voltage of the source node increases from the saturated voltage to the high-level voltage in the switch mode.

3. The display device according to claim 1, wherein a first high-level voltage is applied to a drain electrode of the driving transistor in the saturation mode, and a second high-level voltage lower than the first high-level voltage is applied to the drain electrode of the driving transistor in the switch mode.

4. The display device according to claim 3, wherein a low-level voltage higher than a voltage in a display mode is applied to a cathode of the light-emitting element in the saturation mode, and the cathode of the light-emitting element is electrically floating in the switch mode.

5. The display device according to claim 1, further comprising:

a sensor configured to integrate a current input from the source node of the driving transistor, and output the integrated current as a sensing voltage related to characteristics of the driving transistor.

6. The display device according to claim 5, wherein the sensor includes an amplifier configured to output the sensing voltage in response to the current input from the source node of the driving transistor.

7. The display device according to claim 6, wherein the sensor includes:

an integral capacitor connected between an input terminal of the amplifier and an output terminal of the amplifier; and a first switch connected between ends of the integral capacitor, turned on in the saturation mode, and turned off in the switch mode.

8. The display device according to claim 6, wherein an inverted input terminal, a non-inverted input terminal, and the output terminal of the amplifier are initialized to a reference voltage in the saturation mode, and the amplifier outputs the sensing voltage through the output terminal in response to the current input from the source node of the driving transistor in the switch mode.

9. The display device according to claim 5, wherein the sensor includes:

a second switch connected to the output terminal of the amplifier and configured to sample the sensing voltage; and an analog-to-digital converter configured to convert the sampled sensing voltage into a digital sensing value, and output the digital sensing value.

10. A display device comprising:

a display panel including a plurality of sub-pixels; and a sensor configured to sense a current input from each sub-pixel, wherein each sub-pixel includes:

a light-emitting element configured to emit light;

a switching transistor configured to transfer a voltage input through a data line to a gate node of a driving transistor; and the driving transistor configured to control a quantity of current input to the light-emitting element according to the voltage input to the gate node in a display mode, operate in a saturation mode in which a voltage of a source node of the driving transistor is saturated in response to a first data voltage input to the gate node, and operate in a switch mode in which the driving transistor operates as a switch in response to a second data voltage higher than the first data voltage, so that a driving current generated in the driving transistor is able to be sensed through the source node in a sensing mode.

11. The display device according to claim 10, wherein the driving transistor includes:

a drain electrode to which a high-level voltage is applied;

a gate electrode electrically connected to a first electrode of the switching transistor; and a source electrode electrically connected to an anode of the light-emitting element.

12. The display device according to claim 11, further comprising a power supply configured to:

supply a first high-level voltage to a drain electrode of the driving transistor, supply a low-level voltage higher than a voltage supplied in the display mode to a cathode of the light-emitting element in the saturation mode, supply a second high-level voltage lower than the first high-level voltage to the drain electrode of the driving transistor, and electrically float the cathode of the light-emitting element in the switch mode.

13. The display device according to claim 11, wherein the sensor includes:

an amplifier including an inverted input terminal through which a current is input from the source node of the driving transistor, a non-inverted input terminal through which a reference voltage is input, and an output terminal through which a sensing voltage is output;

an integral capacitor connected between the inverted input terminal and the output terminal; and a first switch connected between ends of the integral capacitor, turned on in the saturation mode, and turned off in the switch mode.

14. A method for driving a display device including light-emitting elements and driving transistors for driving the light-emitting elements, the method comprising:

executing a saturation mode in which a first data voltage is applied to a gate node of each driving transistor so that a voltage of a source node of the driving transistor is saturated; and executing a switch mode in which a second data voltage higher than the first data voltage is applied so that a driving current generated in the driving transistor is able to be sensed through the source node of the driving transistor.

15. The method according to claim 14, wherein the executing of the saturation mode comprises:

applying a first high-level voltage to a drain electrode of the driving transistor; and applying a low-level voltage higher than a voltage supplied in a display mode to a cathode of each light-emitting element.

16. The method according to claim 14, wherein the executing of the switch mode comprises:

applying a second high-level voltage higher than the first high-level voltage to the drain electrode of the driving transistor; and electrically floating the cathode of each light-emitting element.

17. The method according to claim 14, further comprising:

integrating a current input from the source node of the driving transistor; and outputting the integrated current as a sensing voltage related to characteristics of the driving transistor.

18. The method according to claim 17, wherein the display device includes a sensor including:

an amplifier having an inverted input terminal through which the current is input from the source node of the driving transistor, a non-inverted input terminal through which a reference voltage is input, and an output terminal through which the sensing voltage is output, an integral capacitor connected between the inverted input terminal and the output terminal, and a first switch connected between ends of the integral capacitor, and the method comprising:

turning on the first switch so that the inverted input terminal, the non-inverted input terminal, and the output terminal of the amplifier are initialized to the reference voltage in the saturation mode; and turning off the first switch so that the current input from the source node of the driving transistor is received through the inverted input terminal of the amplifier and the sensing output is output through the output terminal in the switch mode.

* * * * *